US005368306A

United States Patent [19]

Madsen

[11] Patent Number: 5,368,306

[45] Date of Patent: Nov. 29, 1994

[54] GAME FOR IMPROVING EYE-HAND COORDINATION

[76] Inventor: Harry Madsen, 2203 Mole Ave., Janesville, Wis. 53546

[21] Appl. No.: 42,153

[22] Filed: Apr. 2, 1993

[51] Int. Cl.[5] ..... A63B 59/00; A63B 67/00

[52] U.S. Cl. ..... 273/318; 273/67 R; 273/323; 273/412

[58] Field of Search ..... 273/317, 318, 323, 328, 273/412, 319, 320, 321, 329, 330, 331, 333, 334, 335, 413, 414, 67 R

[56] References Cited

U.S. PATENT DOCUMENTS

| | | | |
|---|---|---|---|
| 570,047 | 10/1896 | Patrick | 273/321 |
| 578,491 | 3/1897 | Knowles | 273/328 X |
| 986,157 | 3/1911 | Fleming | 273/326 |
| 1,559,953 | 11/1925 | Furman | 273/321 |
| 2,131,550 | 9/1938 | Collins | 273/330 |
| 3,012,785 | 12/1961 | O'Brien | 273/325 |
| 3,610,622 | 10/1971 | Haroski | 273/412 |
| 3,825,262 | 7/1974 | Grzybowski et al. | 273/412 |
| 3,990,702 | 11/1976 | Chopp | 273/412 |

FOREIGN PATENT DOCUMENTS

| | | | |
|---|---|---|---|
| 322505 | 12/1929 | United Kingdom | 273/328 |

*Primary Examiner*—William H. Grieb

*Attorney, Agent, or Firm*—Stroud, Stroud, Willink, Thompson & Howard

[57] ABSTRACT

A paddle and ball game, consisting of a paddle with an attached cup-shaped member and a ball, that develops eye-hand coordination, agility, reflexes and concentration.

19 Claims, 3 Drawing Sheets

GAME FOR IMPROVING EYE-HAND COORDINATION

TECHNICAL FIELD

This invention relates generally to games and toys, and in particular, to a paddle and ball game that is particularly well-suited for development of eye-hand coordination of the player.

BACKGROUND OF THE INVENTION

All manner and variety of paddle and ball games are known. Many claim to improve and develop manual dexterity and muscular coordination, stimulate the cardiovascular system, and generally contribute to physical fitness. Many of the games require more than one player, e.g., table tennis. Others use objects other than balls in a variety of circumstances.

Several prior patents relating to paddle and missile games are known. For example, U.S. Pat. No. 578,491 issued to Knowles on Mar. 9, 1897, discloses an elongate paddle with a conical receptacle adapted to receive the pointed end of a dart. The dart is kept in motion by hitting it into the air with the reverse side of the paddle and then caught and seated again in the receptacle. U.S. Pat. No. 986,157 issued Mar. 7, 1911 to Fleming, discloses an hour-glass shaped paddle having a shallow-sided ball-receiving cup in the top half of the paddle and a ball-receiving aperture in the bottom half. A ball is played off surfaces and caught in the cup or through the aperture. U.S. Pat. No. 3,012,785 issued Dec. 12, 1961 to O'Brien, discloses a paddle with a relatively shallow receptacle affixed to one face of the paddle and an aperture or shallow pocket between the receptacle and the proximate end of the paddle opposite the handle end. The aperture or pocket is a seat for a small playing piece such as a jackstone, ball, token or disk. The game is played by tossing the playing piece into the air and catching it in the receptacle as it descends. U.S. Pat. No. 3,610,622 issued Oct. 5, 1971 to Haroski, discloses a basket that is attached to a player's hips or waist for receiving a tethered ball attached proximate the receptacle. By the user moving his or her hips, the ball is set in motion and caught in the basket. U.S. Pat. No. 3,825,262 issued Jul. 23, 1974 to Grzybowski et al., discloses a hand-held vertical support having a plurality of affixed basket-like containers and a tethered ball proximate the bottom of the support. The ball is hurled upward and the support is moved to attempt to catch the ball in one of the baskets.

Despite this diversity of ball and paddle type games in the prior art, a game has not heretofore been developed that is specifically designed to be easily and effectively used by both children and adults for the purpose of improving eye-hand coordination, motor response time, agility, and concentration. The prior art also does not provide a ball and paddle game that can be played on virtually any surface, in any environment, indoors or outdoors, by one or more players, and that maximizes the challenge levels possible in its use by incorporating a feature designed to introduce unpredictability in the trajectory of the ball.

SUMMARY OF THE INVENTION

The present invention provides a paddle and ball game that is specifically designed to be easily and effectively used by people of all ages for both entertainment and improvement of eye-hand coordination, agility and concentration. The game is very versatile and may be played on virtually any surface in any type of environment by children and adults of any skill level.

These and other advantages of the present invention are realized in one aspect thereof in a game that includes a paddle and a ball. The paddle is composed of a blade with opposite planar faces and a handle, and a cup-shaped member that is attached to one of the faces. The weight, size and shape of the paddle is proportioned such that it can be easily held and manipulated by both children and adults. The cup-shaped member has a bottom, upstanding sidewalls and an open top, and is centrally disposed on the blade face. The sidewall height of the cup-shaped member is about 1.5 to 3.5 times the diameter of the ball.

The ball is a small lightweight sphere having a diameter of about 25 mm to 80 mm, preferably about 35 mm to about 50 mm, a weight of approximately 2 to 5 g, and a bounce of about 150 mm to 350 mm. The ball used in the game can be either plastic or rubber in composition and is of a smaller diameter than the height or diameter of the cup-shaped member. The ball is small and lightweight enough so that a small child can readily impart sufficient momentum and speed to the ball to bounce the ball off of a surface. The size of the ball is also small enough so that it can be played off (i.e., bounced off) common indoor surfaces, e.g., in a home, without causing damage should the ball hit an object. Generally, a ball of the basic size and construction of a standard or oversized table tennis ball is most suitable.

It has been found that the speed, bounce and unpredictability of the ball trajectory can be determined, in part, by the size, weight and material of the ball thus providing a means for altering the levels of challenge of the game. For example, a ball constructed of rubber will generally have a slower speed and lower bounce height than a plastic ball of the same diameter. Additionally, lightweight and hollow balls constructed of polymers, e.g., celluloid, are susceptible to forward, side and reverse spin which increases the unpredictability of the trajectory.

In use, the game is played by one or more players in a myriad of ways depending on the level of challenge that is desired or the particular skill needed to be developed. For example, a person of lesser skill and coordination might use a rubber ball and play the game by simply dropping the ball to the ground and catching it in the cup-shaped member after it bounces back up in the air. Alternatively, a highly skilled person could use a smaller plastic ball and play the game by hurling the ball from the cup-shaped member onto a wall and then keeping the ball in play by continuously rehitting the ball as it rebounds off the wall by lining it up with the inside of the cup-shaped member.

Other advantages and a fuller appreciation of the specific attributes of this invention will be gained upon an examination of the following drawings, detailed description of preferred embodiments, and appended claims. It is expressly understood that the drawings are for the purpose of illustration and description only, and are not intended as a definition of the limits of the invention.

BRIEF DESCRIPTION OF THE DRAWINGS

The preferred exemplary embodiment of the present invention will hereinafter be described in conjunction with the appended drawing wherein like designations refer to like elements throughout and in which.

DETAILED DESCRIPTION

Figure 1:
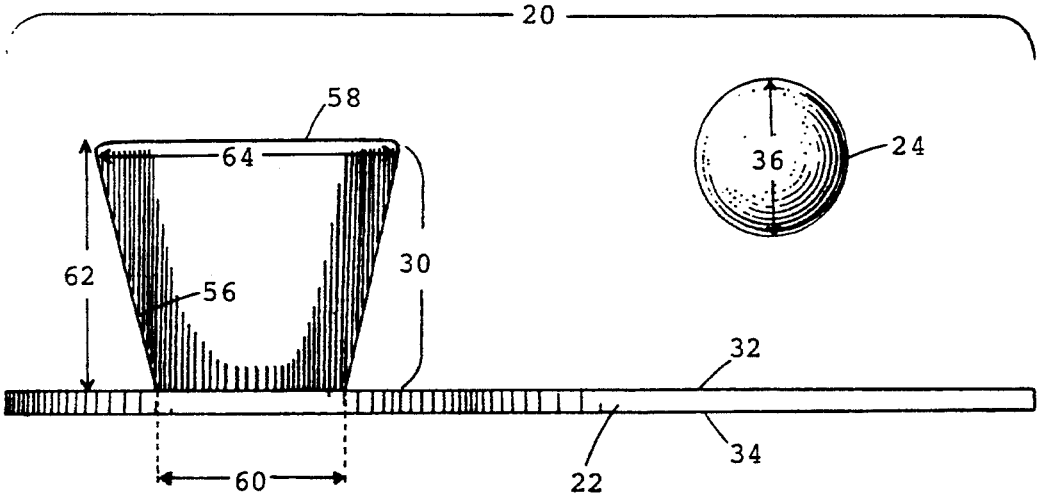
FIG. 1 is a side view of the paddle showing the attached cup.
Figure 2:
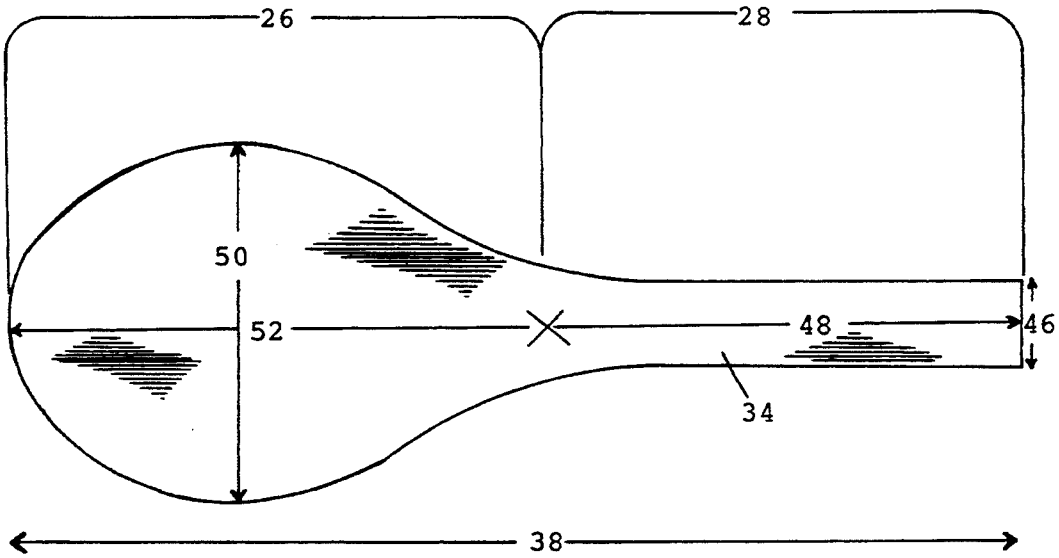
FIG. 2 is a bottom plan view of the paddle showing the shape of the board.

The present invention relates broadly to paddle and ball games. However, the present invention is most particularly adapted for use in the development of eye-hand coordination, agility and concentration in people of all ages. Accordingly, the present invention will now be described in detail with respect to such endeavors; however, those skilled in the art will appreciate that such a description of the invention is meant to be exemplary only and should not be viewed as limitative on the full scope thereof.

As can be seen in FIGS. 1–5, the present invention provides a game 20 that includes a paddle, generally designated as 22, and a ball 24. The paddle 22 includes a blade 26, handle 28, and a cup-shaped member 30. Blade 26 includes two opposite planar surfaces or faces, a front surface 32 and a back surface 34. The cup-shaped member 30 is attached to the front surface 32 of the blade 26. Alternatively, the paddle 22 can be injection molded as a single piece including the cup-shaped member. The ball 24 is a small lightweight sphere and has a diameter 36.

Figure 5:
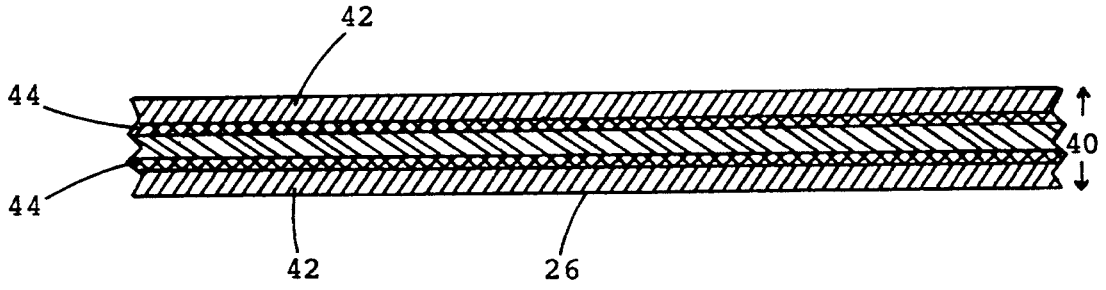
FIG. 5 is a cutaway sectional view of the blade of the paddle in accordance with the present invention illustrating a plywood construction.

The paddle 22 is suitably an overall length 38 of about 30 cm and a thickness 40 of about 6 mm and is made of plywood having at least three plies 42 (as best seen in FIG. 5) or other softwoods. The adhesive layers between the plies may be reinforced with fibrous material 44 such as carbon fiber or fiberglass. Plastics or other materials are also suitable for construction of paddle 22. The handle 28 suitably has a width 46 of about 2.5 cm, a length 48 of approximately 12.7 cm and is about 6 mm in thickness 40. The blade 26, is essentially oblong in shape with a maximum width 50 of about 10 cm to 12 cm and a length 52 of about 15 cm to 16 cm. The material of the blade 26 should suitably have a modulus of elasticity of $1.2\times10^6$ to about $1.8\times10^6$ psi. The weight of the paddle 22 ranges from 80 to 250 g with the preferred embodiment weighing between 80 to 150 g.

Figure 3:
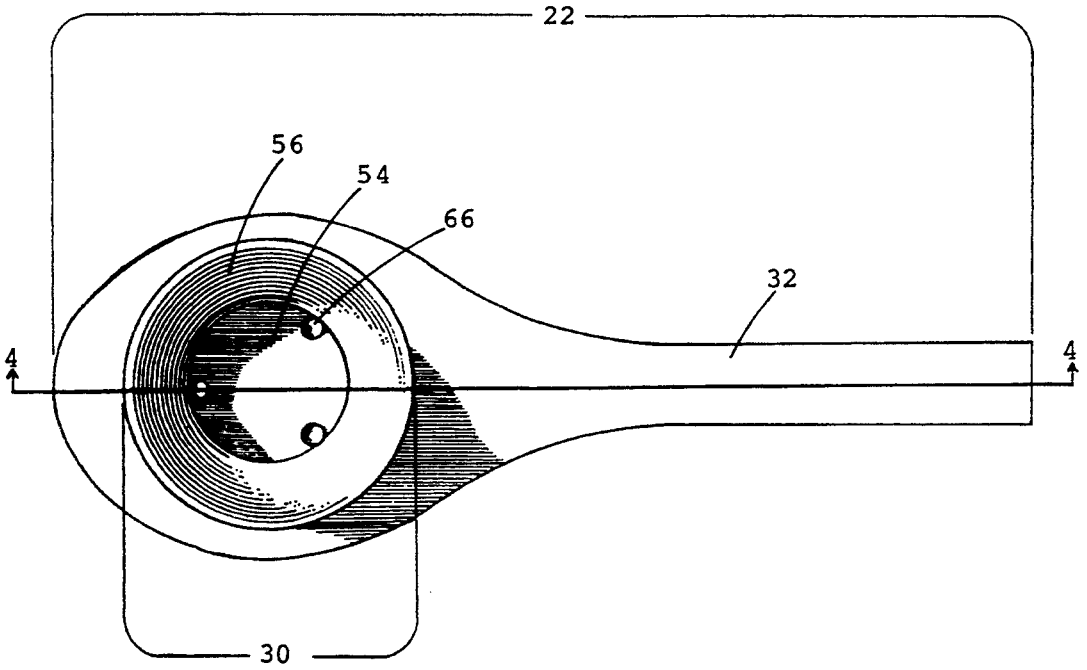
FIG. 3 is a top plan view of the paddle.

As illustrated in FIGS. 1 and 3, the frustoconical cup-shaped member 30 has a circular base 54, upstanding sidewall 56 and open top 58. The base 54 has a diameter 60 of about 50 to 65 mm. The sidewall 56 has a height 62 that is suitably about 60 to 130 mm. The open top 58 has a diameter 64 of about 76 to 90 mm. The height 62 of the sidewall 56 is typically about 1.5 to 3.5 times the diameter 36 of the ball 24 and about 0.8 to 1.1 times the width 50 of the blade 26; the diameter 64 of the open top 58 is suitably about 2 to 2.4 times the diameter 36 of the ball 24.

The cup-shaped member 30 is typically attached to the blade 26 with fasteners such as tubular rivets or screws 66 such that it is centered on front surface 32 of the blade 26. Alternatively, the cup-shaped member 30 may be glued to the blade 26 front surface 32. Also, paddle 22 including cup-shaped member 30 can be injection molded as a single piece.

Figure 4:
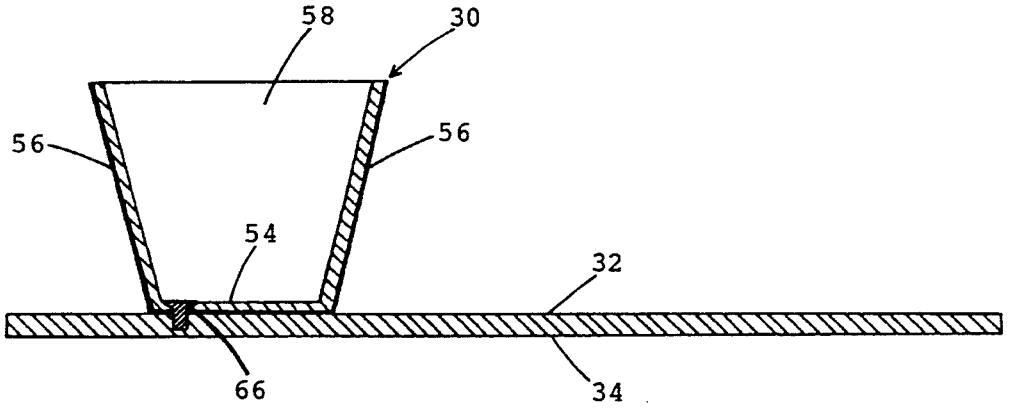
FIG. 4 is a sectional view of the paddle taken through line 4—4 of FIG. 3.

As best shown in FIG. 4, the frustoconical cup-shaped member 30 has an inside surface describing a frustoconical shaped interior space which is bounded by sidewall 56 and base 54.

In one aspect of the invention, ball 24 used to play the game 20, in accordance with the present invention, is suitably the same basic size and construction of standard or oversized table tennis balls that have diameters of about 3.8 cm to about 5.5 cm, respectively. These balls 24 are hollow and composed of a thermoplastic resin such as celluloid, high density polyethylene, polystyrene, polyvinylchloride, vinyl chloride-vinyl acetate copolymers, polymethyl methacrylate, nylon-6,6, nylon-6, polycarbonate, polyacetyl, ethyl cellulose, cellulose proprionate, acetyl butylate, polyester, polysulphone and other similar materials. Ball 24 can also be constructed of rubber and have diameters ranging from about 2.5 to about 7.6 cm. Rubber balls provide a slower playing action than plastic balls because of their greater weight and reduced bouncing action. Ball 24 suitably has a weight of about 2 g to about 5 g and a bounce of about 150 mm to about 350 mm. As used herein, the term "bounce" is meant to describe the height to which a ball will bounce when dropped from a height of 305 mm onto a steel block or a standard table tennis table.

The size, shape and weight of the paddle 22 enable the game 20 to be played easily and effectively by both children and adults without feeling the paddle 22 is either too big or too small. The paddle 22 is easily rotated in the player's hand so that the ball 24 can be played off the back surface 34 of the paddle 22, the front surface 32 with the cup-shaped member 30, or both by rotating the paddle 22 in the hand during play. The game 20 can be played with a paddle 22 in each hand and it can be played with more than one person.

It was found that the paddle 22, dimensioned and configured as described above, best fits the needs of all age groups. For example, it was found that a paddle 22 extending beyond 30 cm in length 38 or 12 cm in width 50 proved too large and clumsy for effective playing and impeded the ease with which the paddle 22 could be rotated in one hand. It was also found that a blade of narrower width 50 provided too small a playing surface and also hindered the efficiency with which the paddle 22 could be rotated in one hand. A 2.5 cm width 46 for the handle 28 was found to be the most preferred because it provided efficient rotating of the paddle 22 in the same hand when the player wants to switch faces of the paddle 22. Cup-shaped members 30 that were more than 130 mm in height 62 were found to be too cumbersome and deterred from the game 20. Handle lengths 48 shorter than 12.7 cm were found to be unsuitable for adults. Conversely, longer handle lengths 48 were found to be too awkward for children.

The combination of the paddle's 22 light weight, the handle width 46, blade 26 shape, and cup-shaped member 30 shape and size as described herein, all maximize the efficiency of play of the game 20 by people of all age groups. These features also, therefore, best contribute to maximal development of eye-hand coordination, agility, and concentration when the game 20 is used.

The way in which the game 20 of the present invention can be played is limited only by the imagination of the player. For example, the game 20 can be initiated by holding the ball 24 in one hand and striking it with the paddle 22, or the ball 24 can be placed in the cup-shaped member 30 and propelled into the air or onto a surface by flipping the paddle 22. The ball 24 can be caught and held in the cup-shaped member 30 or played in and out of the cup-shaped member 30. The ball 24 may be played off of one surface, such as keeping the ball 24 in motion between a floor and the paddle 22, off of multiple surfaces, such as playing the ball 24 off of the corner of a room where the ball 24 would have contact with a floor, ceiling, and two side walls, or the ball 24 could be played strictly off the paddle 22 by continuously hitting it into the air.

The difficulty level of play can be modified in several ways. As mentioned above, play with a plastic ball 24 is faster and therefore more challenging than play with a rubber ball 24. Playing the ball 24 off the back surface 34 of the paddle 22 is easier than if the ball 24 is played off of the front surface 32 with the cup-shaped member 30, because the height 62 and diameters 60 and 64 of the cup-shaped member 30 are greater than the diameter 36 of the ball 24 and when the ball 24 enters the cup-shaped member 30, it can ricochet off of the upstanding sidewall 56 before it exits. Thus, in addition to the difficulty of lining up the ball 24 with a smaller area for contact, there is also the introduction of unpredictability in the trajectory of the ball 24 as it exits out of the cup-shaped member 30. The smaller the ball 24 the greater the unpredictability because of the greater ricochet of the ball around the inside of the cup-shaped member 30 before the ball 24 is ejected. The ricochet will also cause the ball 24 to acquire various spins-back spin, side spin or forward spin-which further alter its trajectory. The difficulty level can also be varied by altering the force with which the ball 24 is hit. The greater the force, the quicker and more difficult the game 20.

The paddle and ball game of the present invention improves eye-hand coordination, agility, reflexes and concentration in numerous ways. To play the game 20, the player must constantly watch the flight of the ball 24 to align the hand holding the paddle 22 with the ball 24, hit the ball 24, and keep the ball 24 in play. The player must also move his or her body to keep up with the position of the rebounding ball 24, particularly if the ball 24 is being played off of multiple surfaces. Thus, successful execution of the game 20 requires constant and intense concentration in addition to good eye-hand coordination and agility. The more challenging and quicker the game action devised, the better the eye-hand coordination, reflexes, agility and concentration of the player must be.

While the present invention has now been described and exemplified with some specificity, those skilled in the art will appreciate the various modifications, including variations, additions, and omissions, that may be made in what has been described. Accordingly, it is intended that these modifications also be encompassed by the present invention and that the scope of the present invention be limited solely by the broadest interpretation that lawfully can be accorded the appended claims.

I claim:

1. A game, comprising:

a paddle including a blade, a handle coextensive with said blade and a cup-shaped member, said blade having a pair of opposed planar faces, said cup-shaped member affixed to one of said pair of faces, and having a closed flat circular bottom and a linearly upstanding sidewall, extending from said bottom and terminating in a circular open top, said circular open top and said bottom each having a diameter, with said diameter of said top greater than said diameter of said bottom, said cup-shaped member having an inside ball striking surface defining a frustoconical interior space, said blade and said handle having a uniform thickness; and a untethered ball, said ball being a lightweight sphere having a diameter of about 35 mm to about 50 mm, a weight of about 2 g to about 5 g, and a bounce of about 150 mm to about 350 mm, wherein said diameter of said top and said diameter of said bottom each exceed said diameter of said ball.

2. The game of claim 1, wherein said sidewall of said cup-shaped member has a height which is about 2.5 times said diameter of said ball.

3. The game of claim 1, wherein said paddle and cup-shaped member together have a weight of about 80 g to about 250 g.

4. The game of claim 1, wherein said blade is substantially oblong, having a length of about 15 cm to about 16 cm and a widest width of about 10 cm to about 12 cm.

5. The game of claim 4, wherein said cup-shaped member is positioned centrally on said blade at said widest width.

6. The game of claim 4, wherein height of said sidewall of said cup-shaped member is 0.8 to 1.1 times said width of said blade.

7. The game of claim 4, wherein said blade is made of a material having a modulus of elasticity of between about $1.2\times10^6$ to about $1.8\times10^6$ psi.

8. The game of claim 7, wherein said material is wood.

9. The game of claim 8, wherein said wood is a plywood having at least three plies.

10. The game of claim 1, wherein said sidewall of said cup-shaped member has a height of about 60 mm to about 130 mm.

11. The game of claim 1, wherein said ball is a hollow sphere and is made of a thermoplastic resin selected from the group consisting of celluloid, high density polyethylene, polystyrene, polyvinylchloride, vinyl chloride-vinyl acetate copolymers, polymethyl methacrylate, nylon-6,6, nylon-6, polycarbonate, polyacetal, ethyl cellulose, cellulose proprionate, cellulose propionate acetyl butylate, polyester and polysulphone.

12. The game of claim 1, wherein said ball is made of rubber.

13. The game of claim 1, wherein said handle is about 12.7 cm long, about 2.5 cm wide and about 6 mm thick.

14. The game of claim 1, wherein said paddle is injection molded as a single piece.

15. The game of claim 1, wherein the base of said cup-shaped member has a diameter of about 50 mm to about 65 mm and the open top has a diameter of about 76 mm to about 90 mm.

16. The game of claim 1, wherein said paddle has an overall length of about 30 cm.

17. A method of developing eye-hand coordination, comprising:

(a) gripping a paddle by a handle, said paddle having a blade opposite said handle, said blade having a pair of opposed planar faces and a frustoconical shaped cup configured and dimensioned to receive a untethered ball, said frustoconical shaped cup affixed to one of said pair of faces, said frustoconical shaped cup having an inside ball striking surface defining a frustoconical interior space;

(b) hitting said untethered ball with one of said pair of faces against a play surface, said untethered ball having a diameter of about 35 mm to about 50 mm, a weight of about 2 g to about 5 g, and a bounce of about 150 mm to about 350 mm; said inside ball striking surface having a diameter dimension exceeding said diameter of said ball; and (c) catching said untethered ball in said inside space of said frustoconical shaped cup.

18. The method of claim 14, further comprising repeating step (b) one or more times.

19. The method of claim 17, wherein step (c) further comprises ricocheting said untethered ball off of said inside ball striking surface of said frustoconical shaped cup and ejecting said ball from said inside space of said frustoconical shaped cup.

* * * * *